US010167720B2

(12) United States Patent
Magee

(10) Patent No.: US 10,167,720 B2
(45) Date of Patent: Jan. 1, 2019

(54) MILLING TOOL HOLDER

(71) Applicant: Caterpillar Paving Products Inc., Brooklyn Park, MN (US)

(72) Inventor: Kevin Magee, Buffalo, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 248 days.

(21) Appl. No.: 14/994,582

(22) Filed: Jan. 13, 2016

(65) Prior Publication Data

US 2017/0198579 A1 Jul. 13, 2017

(51) Int. Cl.

| | |
|---|---|
| ***E21C 35/18*** | (2006.01) |
| ***E21C 35/19*** | (2006.01) |
| ***E21C 25/10*** | (2006.01) |
| *E01C 23/088* | (2006.01) |

(52) U.S. Cl.
CPC ..... *E21C 35/19* (2013.01); *E21C 25/10* (2013.01); *E01C 23/088* (2013.01)

(58) Field of Classification Search
CPC ..... E21C 35/18–35/19
See application file for complete search history.

(56) References Cited

U.S. PATENT DOCUMENTS

| | | | | |
|---|---|---|---|---|
| 5,150,636 | A | 9/1992 | Hill | |
| 5,725,283 | A | 3/1998 | O'Neill | |
| 5,769,505 | A | 6/1998 | Siddle et al. | |
| 5,844,160 | A | 12/1998 | Cieszkiewicz | |
| 6,099,081 | A * | 8/2000 | Warren | E21C 35/187 299/104 |
| 6,176,552 | B1 | 1/2001 | Topka, Jr. et al. | |
| 6,331,035 | B1 * | 12/2001 | Montgomery, Jr. | E21C 35/18 299/102 |
| 6,371,567 | B1 * | 4/2002 | Sollami | B28D 1/188 299/104 |
| 6,786,557 | B2 | 9/2004 | Montgomery, Jr. | |
| 7,578,080 | B2 | 8/2009 | Stoetzer et al. | |
| 7,883,155 | B2 | 2/2011 | Sollami | |
| 7,992,944 | B2 * | 8/2011 | Hall | E21C 35/197 299/110 |
| 8,292,372 | B2 | 10/2012 | Hall et al. | |
| 8,360,699 | B2 | 1/2013 | Stojanovski | |
| 8,517,473 | B2 | 8/2013 | Monyak et al. | |

(Continued)

FOREIGN PATENT DOCUMENTS

| | | |
|---|---|---|
| EP | 0771911 B1 | 8/2001 |
| WO | 2014033227 A2 | 3/2014 |

*Primary Examiner* — Janine M Kreck
(74) *Attorney, Agent, or Firm* — Bookoff McAndrews

(57) ABSTRACT

A tool holder is disclosed for use with a milling drum. The tool holder may have a cylindrical body defining a first end and a second end, the first end configured to be received within a tool mounting block of the milling drum, the second end configured to receive a cutting bit. A flange may be located between the first and second end with respect to an axial direction, and a first bore, with a first opening defined by the second end and extending towards the first end. A frustoconical portion may be located between the flange and the first end with respect to the axial direction and a cylindrical portion located between the flange and the first end. At least one radial opening may pass through at least the wall of the cylindrical portion to intersect or be open to the first bore.

13 Claims, 5 Drawing Sheets

(56) References Cited

U.S. PATENT DOCUMENTS

| | | | | |
|---|---|---|---|---|
| 8,523,290 | B2 | 9/2013 | Helsel et al. | |
| 8,540,320 | B2 | 9/2013 | Sollami | |
| RE44,690 | E | 1/2014 | Sollami | |
| 8,622,482 | B2 | 1/2014 | Sollami | |
| 8,911,024 | B2 | 12/2014 | Fundakowski et al. | |
| 8,950,821 | B2 * | 2/2015 | Fundakowski | E21C 25/10 299/39.8 |
| 9,004,610 | B2 | 4/2015 | Erdmann et al. | |
| 2002/0153175 | A1 * | 10/2002 | Ojanen | E21C 35/197 299/107 |
| 2003/0005606 | A1 * | 1/2003 | Carpenter | E02F 9/28 37/452 |
| 2007/0052279 | A1 | 3/2007 | Sollami | |
| 2009/0261646 | A1 * | 10/2009 | Ritchey | B28D 1/188 299/106 |
| 2010/0320829 | A1 | 12/2010 | Sollami | |
| 2013/0241265 | A1 | 9/2013 | Lehnert et al. | |
| 2015/0028656 | A1 * | 1/2015 | Sollami | E21C 35/18 299/79.1 |
| 2015/0102654 | A1 * | 4/2015 | Zaayman | E21C 35/1936 299/79.1 |
| 2015/0240634 | A1 | 8/2015 | Sollami | |
| 2015/0315910 | A1 | 11/2015 | Sollami | |
| 2017/0198578 | A1 | 7/2017 | Sansone | |
| 2017/0198580 | A1 | 7/2017 | Sansone | |

* cited by examiner

MILLING TOOL HOLDER

TECHNICAL FIELD

The present disclosure relates generally to a tool holder and, more particularly, to a tool holder for a milling drum.

BACKGROUND

Asphalt-surfaced roadways facilitate vehicular travel. Depending upon usage density, base conditions, temperature variation, moisture variation, and/or physical age, the surface of the roadways can eventually become misshapen, non-planar, unable to support wheel loads, or otherwise unsuitable for vehicular traffic. To rehabilitate the roadways for continued vehicular use, worn asphalt is removed in preparation for resurfacing.

Cold planers, sometimes also called road mills or scarifiers, are machines that typically include a frame supported by tracked or wheeled drive units. The frame is configured to provide a mount for an engine, an operator's station, and a milling drum. The milling drum, fitted with cutting tools, is turned through a suitable interface by the engine to break up the surface of the roadway.

In a typical configuration, multiple spiraling rows of cutting tools are oriented on an external surface of the milling drum to converge at a location on the drum corresponding to a location of a material removal component of the machine. The individual cutting bits may be mounted to at least one tool mounting block by tool holders. The tool holders are often mounted to the tool block using a friction or interference connection. For example, U.S. Pat. No. RE44,690 to Sollami discloses a bit holder utilizing a tapered shank and an axially oriented slot through the side wall of the shank to allow an interference fit. U.S. Pat. No. RE44,690 discusses a bit holder with a mating bit block utilizing a slight taper in a bit block bore, and a tapered shank on the bit holder that includes a second larger diameter tapered distal segment that combines with an axially oriented slot through the side wall of the bit holder shank to allow a substantially larger interference fit between the distal tapered shank segment and the bit block bore than previously known. When inserting the bit holder in the bit block bore, the distal first tapered segment resiliently collapses to allow insertion of that segment into the bit block bore. A second shank tapered portion can be located axially inwardly of the first distal tapered portion. The dual tapered shank allows the insertion of the bit holder in the bit block with an interference fit that provides a secure mounting of the bit holder in the bit block.

Through use of the milling drum, the tool holders can be damaged or broken. Current tool holder designs may require the machine being taken out of service frequently or for long periods to replace lost or broken tool holder. The tool holder and milling drum of the present disclosure solve one or more of the problems set forth above and/or other problems in the art.

SUMMARY

In one aspect, the present disclosure relates to a tool holder configured to be coupled to a tool mounting block of a milling drum. The tool holder may include a cylindrical body defining a first end configured to be received within a tool mounting block of the milling drum and the cylindrical body defining a second end, the second end configured to receive a cutting bit. The tool holder may also include a flange located between the first and second end with respect to an axial direction, and a first bore, with a first opening defined by the second end and extending along the axial direction towards the first end. The tool holder may further include a frustoconical portion located between the flange and the first end with respect to the axial direction and a cylindrical portion located between the flange and the first end with respect to the axial direction. The tool holder additionally may include at least one radial opening that extends through at least the wall of the cylindrical portion to intersect or be open to the first bore.

In another aspect, the present disclosure relates to a bit configured to be couple to a tool mounting block of a milling drum. The bit may include a cylindrical body defining a first end configured to be received within a tool mounting block of the milling drum, and the cylindrical body defining a second end, the second end including a tip. The bit may also include a flange located between the first end and the second end with respect to an axial direction and a first bore with a first opening defined by the first end, the first bore extending along the axial direction towards the second end. The bit may further include a frustoconical portion located between the flange and the first end with respect to the axial direction, a cylindrical portion located between the flange and the first end, with respect to the axial direction, and at least one radial opening that extends through the wall of at least the cylindrical portion to intersect or be open to the first bore.

In a further aspect, the present disclosure relates to a milling drum. The milling drum may include a head having a cylindrical outer surface, a plurality of tool mounting blocks arranged into spiraling rows on the cylindrical outer surface of the head, and a plurality of tool holders. Each of the plurality of tool holders may include a cylindrical body defining a first end received within a corresponding one of the plurality of tool mounting blocks, and the cylindrical body defining a second end, the second end configured to receive a cutting bit. Each of the plurality of tool holders may further include a flange located between the first end and the second end, with respect to an axial direction, a first bore with a first opening defined by the second end, the first bore extending along the axial direction towards the first end, a frustoconical portion located between the flange and the first end, with respect to the axial direction, a cylindrical portion located between the flange and the first end, with respect to the axial direction, and at least one radial opening that extends through the wall of at least the cylindrical portion to intersect or be open to the first bore.

In another aspect, the present disclosure relates to another tool holder configured to be coupled to a tool mounting block of a milling drum. This tool holder may include a cylindrical body defining a first end configured to be received within a tool mounting block of the milling drum and the cylindrical body defining a second end, the second end configured to receive a cutting bit. The tool holder may also include a flange located between the first and second end with respect to an axial direction, and a first bore, with a first opening defined by the second end, the first bore extending along the axial direction towards the first end. The tool holder may further include a frustoconical portion located between the flange and the first end, with respect to the axial direction and an elliptical portion located between the flange and the first end, with respect to the axial direction.

In a further aspect, the present disclosure relates to another bit configured to be coupled to a tool mounting block of a milling drum. This bit may include a cylindrical body defining a first end configured to be received within a tool mounting block of the milling drum and the cylindrical body defining a second end, the second end including a tip. The bit may also include a flange located between the first and second end, with respect to an axial direction, and a first bore, with a first opening defined by the first end, the first bore extending along the axial direction toward the second end. The bit may further include a frustoconical portion located between the flange and the first end, with respect to the axial direction, and an elliptical portion located between the flange and the first end, with respect to the axial direction.

In a further aspect, the present disclosure relates to a milling drum. The milling drum may include a head having a cylindrical outer surface, a plurality of tool mounting blocks arranged into spiraling rows on the cylindrical outer surface of the head, and a plurality of tool holders. Each of the plurality of tool holders may include a cylindrical body defining a first end received within a corresponding one of the plurality of tool mounting blocks, and the cylindrical body defining a second end, the second end configured to receive a cutting bit. Each of the plurality of tool holders may further include a flange located between the first end and the second end, with respect to an axial direction, a first bore with a first opening defined by the second end, the first bore extending along the axial direction towards the first end, a frustoconical portion located between the flange and the first end, with respect to the axial direction, and an elliptical portion located between the flange and the first end, with respect to the axial direction.

In another aspect the present disclosure relates to yet another tool holder configured to be coupled to a tool mounting block of a milling drum. This tool holder may include a cylindrical body defining a first end configured to be received within a tool mounting block of the milling drum and the cylindrical body defining a second end, the second end configured to receive a cutting bit. The tool holder may also include a flange located between the first and second end, with respect to an axial direction, and a first bore, with a first opening defined by the second end, the first bore extending along the axial direction towards the first end. The tool holder may further include a frustoconical portion located between the flange and the first end, with respect to the axial direction, and a polygonal portion with a cross section that is a finitely-sided polygon located between the flange and the first end, with respect to the axial direction.

In another aspect, the present disclosure relates to yet another bit configured to be coupled to a tool mounting block of a milling drum. This bit may include a cylindrical body defining a first end configured to be received within a tool mounting block of the milling drum and the cylindrical body defining a second end, the second end including a tip. The bit may also include a flange located between the first and second end, with respect to an axial direction, and a first bore, with a first opening defined by the first end, the first bore extending along the axial direction towards the second end. The bit may further include a frustoconical portion located between the flange and the first end, with respect to the axial direction and a polygonal portion with a cross section that is a finitely-sided polygon located between the flange and the first end, with respect to the axial direction.

In a further aspect, the present disclosure relates to yet another milling drum. The milling drum may include a head having a cylindrical outer surface, a plurality of tool mounting blocks arranged into spiraling rows on the cylindrical outer surface of the head, and a plurality of tool holders. Each of the plurality of tool holders may include a cylindrical body defining a first end received within a corresponding one of the plurality of tool mounting blocks, and the cylindrical body defining a second end, the second end configured to receive a cutting bit. Each of the plurality of tool holders may further include a flange located between the first end and the second end, with respect to an axial direction, a first bore with a first opening defined by the second end, the first bore extending along the axial direction towards the first end, a frustoconical portion located between the flange and the first end, with respect to the axial direction and a polygonal portion with a cross section that is a finitely-sided polygon located between the flange and the first end, with respect to the axial direction.

DETAILED DESCRIPTION

Figure 1:
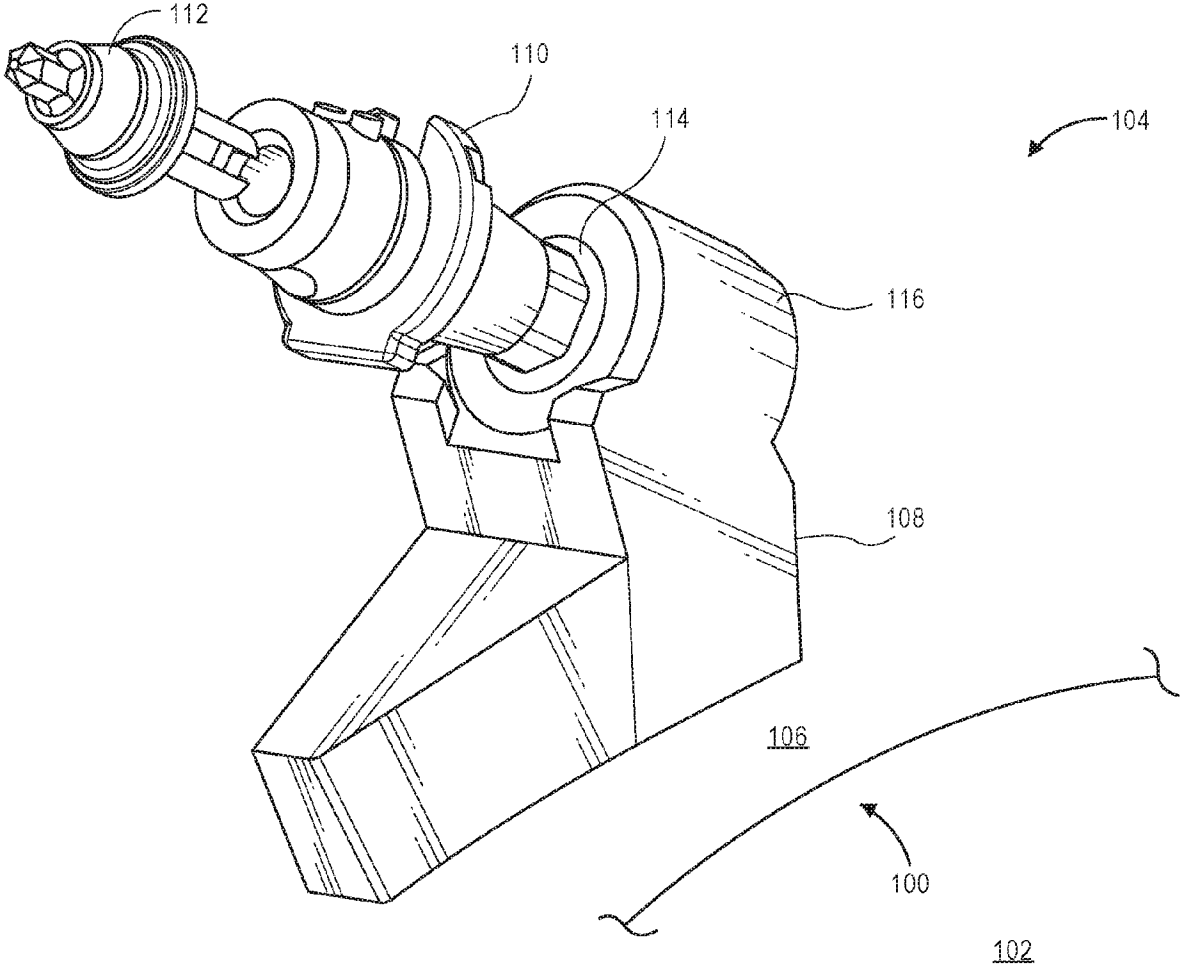
FIG. 1 is an exploded view of an exemplary disclosed cutting bit, tool holder, and tool mounting block.

Now referring to the drawings, wherein like reference numbers refer to like elements, there is illustrated a milling drum head 100 which is the outer portion of a milling drum 102 which can be attached to a machine (not shown). The machine can be one that is used for road milling such as a cold planer or may be any other type of machine that performs some type of milling operation known in the art.

For the purpose of this disclosure, the term "asphalt" may be defined as a mixture of aggregate and asphalt cement. Asphalt cement may be a brownish-black solid or semi-solid mixture of bitumen obtained as a byproduct of petroleum distillation. The asphalt cement may be heated and mixed with the aggregate for use in paving roadway surfaces, where the mixture hardens upon cooling. A "cold planer" may be defined as a machine used to remove layers of hardened asphalt from an existing roadway. It is contemplated that the disclosed cold planer may also or alternatively be used to remove lime-based cement, concrete, and other roadway surfaces, if desired.

Referring to FIG. 1, the milling drum head 100 can have one or more cutting assemblies 104 arranged upon an outer surface 106 of the milling drum head 100. The cutting assemblies 104 may be arranged in such a way that the rotation of the milling drum 102 can cause the cutting assemblies 104 to fragment and remove material from the roadway surface and channel it to a collection device (not shown). In the aspect shown in FIG. 1, an exemplary aspect of the cutting assembly 104 is shown, comprising a tool mounting block 108, a tool holder 110, and a cutting bit 112.

The tool mounting block 108 can be fixed to the milling drum head 100, for example, by welding, and can be configured to removably receive the tool holder 110 in a mounting bore 114 of a mounting portion 116. Each of the tool holders 110 may also be configured to removably receive the cutting bit 112. In another aspect, the tool holder 110 and the cutting bit 112 may be made as a single part with the cutting bit 112 being formed integral with the tool holder 110.

Figure 2:
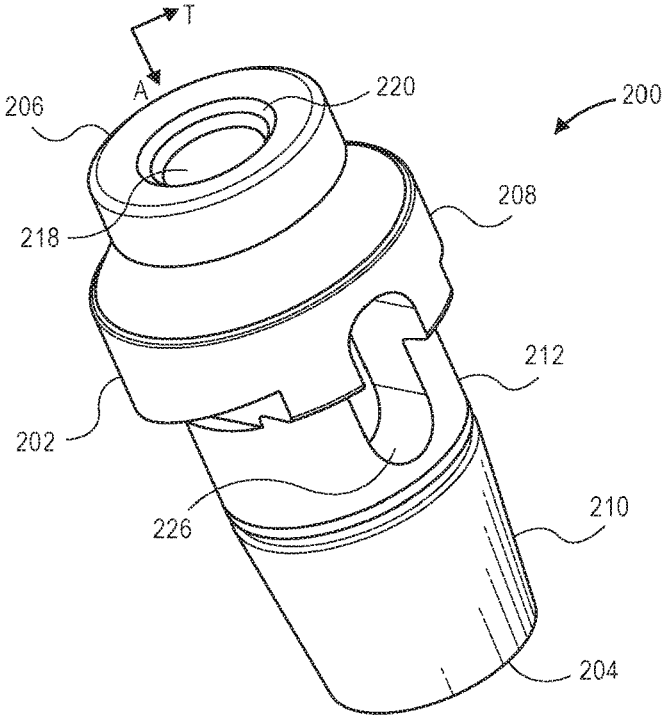
FIG. 2 is an isometric view of another exemplary disclosed tool holder that may be used in conjunction with the cutting bit and tool mounting block of FIG. 1.
Figure 3:
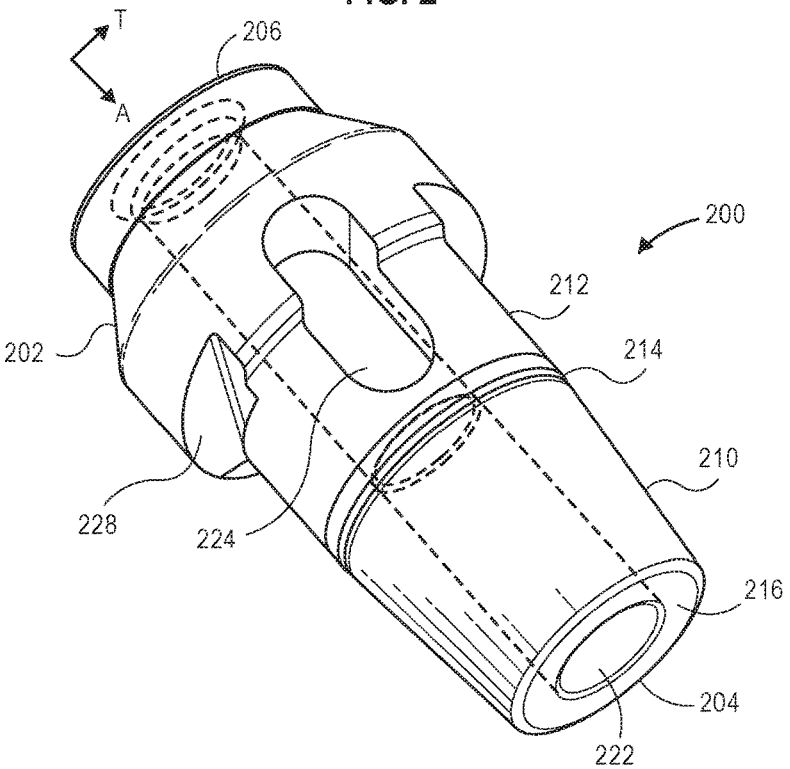
FIG. 3 is another isometric view of the tool holder of FIG. 2 that may be used in conjunction with the cutting bit and tool mounting block of FIG. 1.
Figure 4:
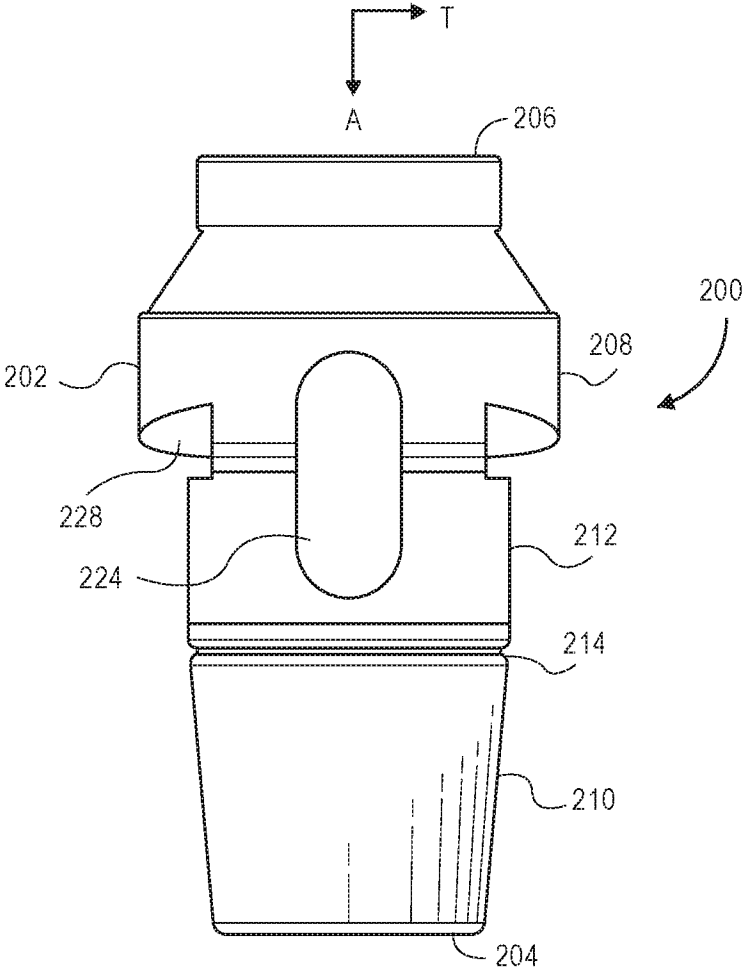
FIG. 4 is a side view of the tool holder of FIG. 2 that may be used in conjunction with the cutting bit and tool mounting block of FIG. 1.

Referring now to FIGS. 2-4, an exemplary aspect of a tool holder 200 configured to be removably installed in the tool mounting block 108 (FIG. 1) and to receive the cutting bit 112 (FIG. 1) is shown. FIGS. 2 and 3 illustrate isometric views of tool holder 200, and FIG. 4 illustrates a side view of the tool holder 200. The tool holder 200 may include a cylindrical body 202 having a first end 204 and an opposing second end 206. In an aspect, the cylindrical body 202 may be cylindrically shaped, although in other aspects other shapes are possible, including but not limited to, a generally cylindrical shape. The first end 204 may be configured for insertion into the mounting bore 114 (FIG. 1) of the mounting portion 116 (FIG. 1) of the tool mounting block 108 (FIG. 1) while the second end 206 is configured to receive the cutting bit 112 (FIG. 1). A flange 208 may be located between the first and second ends 204, 206 with respect to an axial direction A such that a first distance from the flange 208 to the second end 206, as measured in the axial direction A, is less than a second distance from the first end 204 to the second end 206, as measured in the axial direction A. In an aspect as seen in FIG. 2, the flange 208 may be located closer to the second end 206 than to the first end 204 with respect to the axial direction A; however, in other aspects other arrangements may be possible, for example, the flange 208 may be located equidistant from the first and second ends 204, 206 with respect to the axial direction A.

The tool holder 200 may have a frustoconical portion 210 located between the first end 204 and the flange 208 with respect to the axial direction A. The frustoconical portion 210 may be frustoconically shaped, although in other aspects other shapes may be possible, including but not limited to, a generally frustoconical shape. The frustoconical portion 210 may form a taper fit with the mounting bore 114 (FIG. 1) to secure the tool holder 200 in the tool mounting block 108 (FIG. 1). The frustoconical portion 210 is configured such that the frustoconical portion 210 tapers in the axial direction A so that a portion of frustoconical portion 210 that is located axially nearer to the first end 204 is of a smaller diameter than a portion located axially further from the first end 204.

The angle with which the frustoconical portion 210 tapers may be between about 0° and about 9°. The frustoconical portion may also be tapered as a Morse taper. Morse tapers are a set of specific taper profiles recognized by the International Organization for Standardization (ISO) as ISO 296. Morse tapers are approximately ⅝ inch of taper per foot (e.g., the diameter changes by ⅝ inch for every foot of axial length) but vary slightly depending on the specific Morse taper employed. The frustoconical portion 210 may further be tapered so that when the tool holder 200 is installed in the tool mounting block 108 (FIG. 1) a self-holding taper is formed. A self-holding taper for the purpose of this disclosure is defined as a taper where the male remains installed within the female without the use of any external force or fasteners, using only the friction of the taper fit.

The tool holder 200 may additionally have a cylindrical portion 212 located between the first end 204 and the flange 208 with respect to the axial direction A. As discussed more below, the cylindrical portion 212 may form a press fit with the mounting bore 114 (FIG. 1) to secure the tool holder 200 in the tool mounting block 108 (FIG. 1). In an aspect, the cylindrical portion 212 may be cylindrically shaped, although in other aspects other shapes may be possible, including but not limited to a generally cylindrical shape. In the aspect of the disclosure illustrated in FIGS. 2-4 the cylindrical portion 212 is located such that, a distance from the cylindrical portion 212 to the flange 208, with respect to the axial direction A is less than a distance from the frustoconical portion 210 to the flange 208, with respect to the axial direction A. However, other orientations may be possible; for example, the cylindrical portion 212 may be located such that a distance from the cylindrical portion 212 to the flange 208, with respect to the axial direction A, is greater than a distance from the frustoconical portion 210 to the flange 208, with respect to the axial direction A.

In the aspect illustrated in FIGS. 2-4 the diameter, as measured in a transverse direction T defined as perpendicular to the axial direction A, of the cylindrical portion 212 may be greater than the largest diameter of the frustoconical portion 210, but smaller than the diameter of the flange 208. In an alternative aspect, the diameter of the cylindrical portion 212 as measured in the transverse direction T may be smaller than the smallest diameter of the frustoconical portion 210.

The tool holder 200 may further have a recessed region 214 located between the frustoconical portion 210 and the cylindrical portion 212, with respect to the axial direction A, and spanning the circumference of the tool holder 200. The recessed region 214 may be a region of a wall 216 of the cylindrical body 202 with reduced thickness in the transverse direction T. The recessed region 214 may have diameters, measured in the transverse direction T, smaller than the abutting portions of the frustoconical portion 210 and the cylindrical portion 212. In the aspect illustrated in FIGS. 2-4 the recessed region 214 has an axial length substantially smaller than the axial length of the frustoconical portion 210 or the cylindrical portion 212. The radial profile of the recessed region 214 may be rounded, triangular, square, another shape known in the art or some combination of the preceding. The recessed region 214 may serve to provide a spacer between the frustoconical portion 210 and the cylindrical portion 212, with respect to the axial direction A, so that the taper fit and press fit of the frustoconical portion 210 and the cylindrical portion 212 respectively are fully engaged when the tool holder 200 is installed in the tool mounting block 108 (FIG. 1).

The tool holder 200 illustrated in FIGS. 2-4 may additionally have a first bore 218 with a first opening defined by the second end 206 of the tool holder 200 that extends in the axial direction A towards the first end 204. The depth of the first bore 218 may extend with respect to the axial direction A such that the bore terminates within the recessed region 214; however other depths of the first bore 218 may be possible. The first bore 218 may be configured to receive the cutting bit 112 (FIG. 1). In certain aspects, the first bore 218 may span the entire axial length of the tool holder 200, reaching the first end 204 to create a through bore. It is also contemplated that the first bore 218 may also be a blind bore that runs only a portion of the axial length of tool holder 200. The first bore 218 may further have an internal chamfer 220 at an open end thereof to ease assembly of the cutting bit 112 (FIG. 1) into the tool holder 200. In some aspects, the first bore 218 may have a diameter sized to receive cutting bit 112 (FIG. 1) via a press fit interference.

The tool holder 200 illustrated in FIGS. 2-4 may additionally have a second bore 222 with a first opening defined by the first end 204. The second bore 222 may be generally aligned with the first bore 218 in the axial direction A and may extend axially towards the second end 206. The diameter of the second bore 222, as measured in the transverse direction T, may be the same as the first bore 218. In another aspect, the first bore 218 may have a larger diameter than the second bore 222, as measured in the transverse direction T, and in yet another aspect the first bore 218 may have a smaller diameter than the second bore 222, as measured in the transverse direction T. In the aspect disclosed in FIGS. 2-4 the second bore 222 may extend along the axial direction A to the recessed region 214; however other depths of the second bore 222 may be possible.

According to one aspect of the disclosure the second bore 222 may extend axially to intersect or be open to the first bore 218. According to another aspect of the disclosure the first bore 218 and the second bore 222 may not intersect or be open to each other such that a solid portion (not shown) may remain between the first and second bore 218, 222 with respect to the axial direction A. The solid portion may be configured to improve shear strength of the tool holder 200 at a certain axial location. The second bore 222 may function to reduce the weight of tool holder 200 and in the aspect where the first and second bore 218, 222 intersect or are open to each other a tool (not shown) may be inserted into the second bore 222 to interact with the internal end of the cutting bit 112 (FIG. 1) to remove cutting bit 112 (FIG. 1) from the tool holder 200 during servicing.

A radial opening 224 may extend through a wall 226 of the cylindrical portion 212 of the tool holder 200. In certain aspects, the radial opening 224 may allow the cylindrical portion 212 to be compressed when installed into the mounting bore 114 (FIG. 1) of the tool mounting block 108 (FIG. 1) to obtain a press fit interference that may be more secure than could be obtained without the compression of the cylindrical portion 212. The radial opening 224 may further provide access to the internal end of cutting bit 112 (FIG. 1), such that the cutting bit 112 (FIG. 1) may be pried out of the tool holder 200 during servicing. In the tool holder 200 of FIG. 4, the radial opening 224 is oriented orthogonally relative to the axis of the tool holder 200, however, it is contemplated that the radial opening 224 may be inclined toward the first end 204 to provide greater access to the internal end of the cutting bit 112 (FIG. 1) and/or pry leverage.

In the tool holder 200 illustrated in FIGS. 2-4 the radial opening 224 is shown partially intersecting the flange 208. The length of the radial opening 224 as measured along the axial direction A may be less than the length of the cylindrical portion 212 as measured along the axial direction A. In another aspect, the length of the radial opening 224, as measured along the axial direction A, may be equal to the length of the cylindrical portion 212 as measured along axial direction A. In a further aspect, the length of the radial opening 224, as measured along the axial direction A, may be greater than the length of the cylindrical portion 212, as measured along the axial direction A.

In certain aspects, the radial opening 224 may bisect the flange 208 in the axial direction A. In another aspect, the radial opening 224 may not intersect the flange 208. The radial opening 224 may be an oblong shape; however, other shapes may be possible, such as a circle or an ellipse. The radial opening 224 is contemplated as a single opening, as seen in FIG. 4, for example; however, in other aspects a plurality of radial openings 224 is also contemplated. In one aspect, the radial opening 224 may intersect or be open to the first bore 218. In another aspect, the radial opening 224 may intersect or be open to the second bore 222. In a further aspect, the radial opening 224 may intersect or be open to both of the bores 218, 222.

The tool holder 200 may also have one or more recesses 228 in the flange 208. The recesses 228 may facilitate the removal of the tool holder 200 from the tool mounting block 108 (FIG. 1), by allowing a prying tool (not shown) to be inserted into the recesses 228 to remove the tool holder 200 during servicing. The recesses 228 may be rounded, square, another shape known in the art, or some combination. In the aspect illustrated in FIGS. 2-4 two recesses 228 axially opposed are contemplated, but a different number and orientation of recesses may also be possible.

In some aspects, the cutting bit 112 (FIG. 1) may have a cylindrical body configured to be received within the tool holder 200, and include a pointed hardened tip that engages the roadway surface during operation. In one aspect, the tip of cutting bit 112 (FIG. 1) may be fabricated from tungsten carbide, though other materials may also or alternatively be utilized. Although not shown, the cutting bit 112 (FIG. 1) may also include a spring clip that surrounds the cylindrical body and functions to retain the cutting bit 112 (FIG. 1) within the tool holder 200, as is known in the art.

Figure 5:
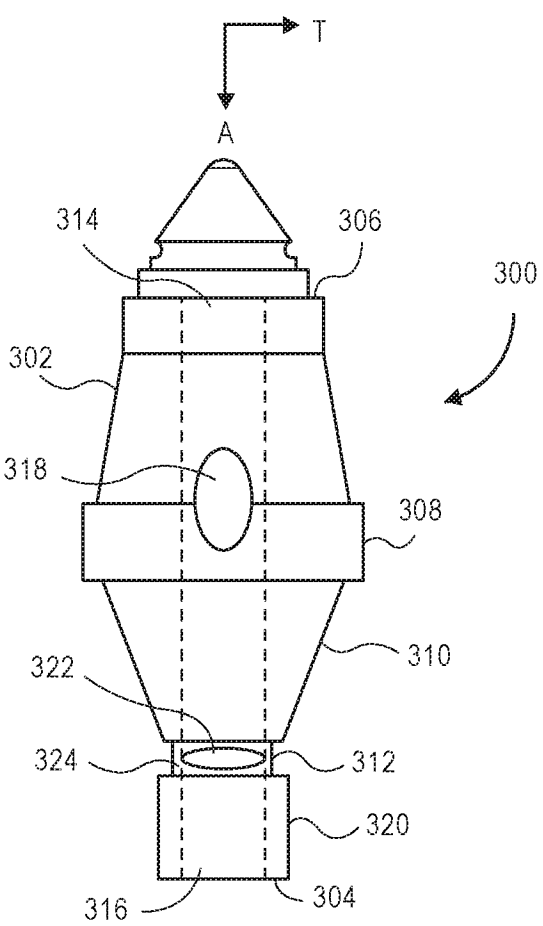
FIG. 5 is a side view of another exemplary disclosed tool holder that may be used in conjunction with the tool mounting block of FIG. 1.

Referring now to FIG. 5, a side view of an exemplary aspect of an alternative tool holder 300 is shown. The tool holder 300, may include a cylindrical body 302 having a first end 304, an opposing second end 306, and a flange 308 located between a first and a second end 304, 306, with respect to the axial direction A. The tool holder 300 may also include a frustoconical portion 310, a recessed region 312, a first bore 314, a second bore 316, and a radial opening 318. In an aspect, the flange 308 of the tool holder 300 is contemplated nearer to the first end 304, with respect to the axial direction A; however, other locations of the flange 308 are also contemplated. The radial opening 318 of the tool holder 300 may be located to partially intersect the flange 308. In another aspect the radial opening 318 may be located to completely intersect the flange 308. In yet another aspect, the radial opening 318 may be located completely between the flange 308 and the second end 306, with respect to the axial direction A. In a further aspect, the radial opening 318 may be located partially between the flange 308 and the second end 306, with respect to the axial direction A.

The tool holder 300 may also have an elliptical portion 320 located in the axial direction A between the first end 304 and the flange 308. As discussed in more detail below, the elliptical portion 320 may form a press fit with the mounting bore 114 (FIG. 1) to secure the tool holder 300 in the tool mounting block 108 (FIG. 1). In an aspect, the elliptical portion 320 may be elliptically shaped, although, in other aspects other shapes may be possible, including but not limited to, a generally elliptical shape. In the aspect shown in FIG. 5 the elliptical portion 320 is contemplated to be located such that a distance from the elliptical portion 320 to the flange 308, with respect to the axial direction A, is greater than a distance from the frustoconical portion 310 to the flange 308, with respect to the axial direction A.

However, the frustoconical portion 310 and the elliptical portion 320 may be reversed so that the elliptical portion 320 is located such that a distance from the elliptical portion 320 to the flange 308, with respect to the axial direction A, is less than a distance from the frustoconical portion 310 to the flange 308, with respect to the axial direction A. The recessed region 312 of the tool holder 300 may have a radial opening 322 through a wall 324 of the recessed region 312. The radial opening 322 may intersect or be open to the first bore 314. In another aspect, the radial opening 322 may intersect or be open to the second bore 316. In a further aspect, the radial opening 322 may intersect or be open to both the bores 314, 316.

Figure 6:
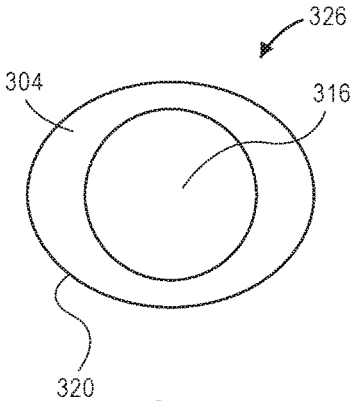
FIG. 6 is a sectional view of the profile of the tool holder of FIG. 5.
Figure 7:
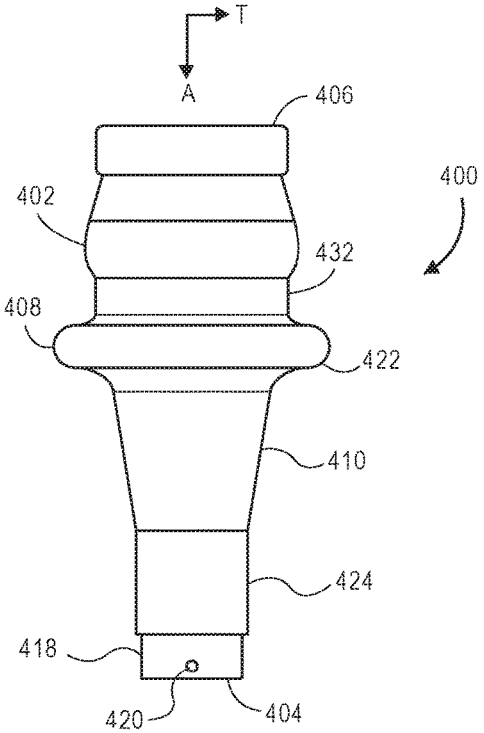
FIG. 7 is a side view of yet another exemplary disclosed tool holder that may be used in conjunction with the tool holder and tool mounting block of FIG. 1.

Referring now to FIG. 6, the elliptical portion 320 may have a cross section 326 orthogonal to the axial direction A that is elliptical. The cross section 326 is contemplated as an ellipse with a major diameter that is at least measurably larger than a minor diameter of the ellipse, but other dimensions and proportions may be possible. The tool holder 300 may be installed in the tool mounting block 108 to create a press fit by inserting the elliptical portion 320 into the mounting bore 114. In this aspect at least the major diameter of the elliptical portion 320 may be greater than a diameter of the mounting bore 114 that is in contact with the elliptical portion 320 when the tool holder 300 is installed in the mounting bore 114. The mounting bore 114 is contemplated as cylindrical, but other shapes or dimensions may be possible.

In another aspect, the tool holder 300 may be installed in the tool mounting block 108 to create a press fit by inserting the elliptical portion 320 into the mounting bore 114 and rotating the tool holder 300 about a central axis defined by axial direction A. In such an aspect the mounting bore 114 is contemplated as being elliptical, however other shapes and dimensions may be possible. The tool holder 300 may be rotated until the major axis of the elliptical portion 320 is offset from a major axis of the mounting bore 114 sufficiently to create a press fit between a portion of a surface of the elliptical portion 320 and a portion of an interior surface of the mounting bore 114.

Referring now to FIGS. 7-11, an exemplary aspect of another alternative tool holder 400 is shown. The tool holder 400 may include a cylindrical body 402 having a first end 404, an opposing second end 406, and a flange 408 located between a first and a second end 404, 406, with respect to the axial direction A. The tool holder 400 may also include a frustoconical portion 410, a first bore 412, a chamfer 414, and a second bore 416. Although not shown in the aspects illustrated in FIGS. 7-11, it is contemplated that the tool holder 400 may have a radial opening similar to the radial openings 224 and 318 of the tool holders 200 and 300 respectively.

In certain aspects, the tool holder 400 may be pressed into the mounting bore 114 (FIG. 1) of the mounting portion 116 (FIG. 1), such that a tail portion 418 may protrude from the lower axial end of the mounting portion 116 (FIG. 1). In this state, a pin (e.g., a roll pin or a cotter pin not shown) may be inserted through a cross-hole 420 located within the tail portion 418 and extend from opposing sides of the outer surface of the cylindrical body 402 to inhibit separation or exiting of the tool holder 400 from the mounting portion 116 (FIG. 1). In certain aspects, the pin may be intended primarily to inhibit separation during transport, as opposed to during operation. The tail portion 418 is contemplated as having a cylindrical shape but other shapes may be possible.

The tool holder 400 may have a rounded edge 422. The tool holder 400 may also have a polygonal portion 424. As discussed in more detail below, the polygonal portion 424 may form a press fit with the mounting bore 114 (FIG. 1) to secure the tool holder 400 in the tool mounting block 108 (FIG. 1). In an aspect, the polygonal portion 424 may be polygonally shaped, although in other aspects other shapes may be possible, including but not limited to, a generally polygonal shape. The polygonal portion 424 may be located in the axial direction A between the first end 404 and the flange 408.

Figure 8:
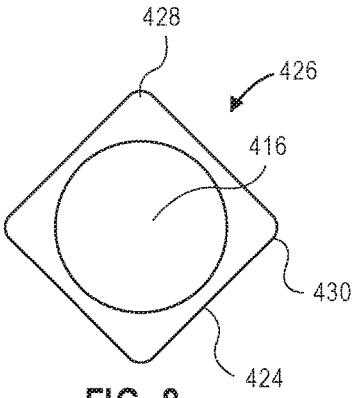
FIG. 8 is a sectional view of the profile of the tool holder of FIG. 7.
Figure 9:
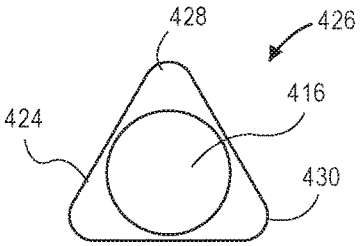
FIG. 9 is a sectional view of an alternate profile of the tool holder of FIG. 7.
Figure 10:
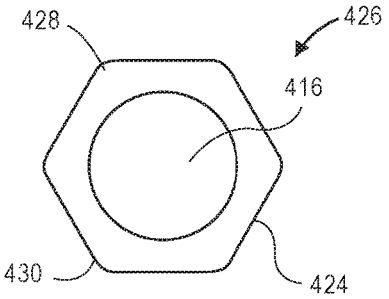
FIG. 10 is a sectional view of another alternate profile of the tool holder of FIG. 7.

The polygonal portion 424 may have a cross section 426 orthogonal relative to the axial direction A that generally forms a polygon of at least three sides (i.e. a triangle). The cross section 426 is contemplated to be a polygon between 3 and 12 sides; however other dimensions and shapes may also be possible. FIGS. 8, 9, and 10 illustrate three possible cross sections 426 of the polygonal portion 424 of the tool holder 400, although in other aspects other cross sections may be used. FIGS. 8, 9, and 10 further illustrate one or more vertices 428 where line segments join to form a polygonal shape. The aspect of the tool holder 400 disclosed in FIG. 6 contemplates a radius 430 at each of the vertices 428, although other configurations may be possible. The radius is contemplated as small when compared to the length of the sides of the polygonal shape comprising the polygonal portion 424. It is further contemplated that the cross section 426 forms a regular polygon, (e.g., all vertices 428 are equidistant from the central axis of the tool holder 400) although non-regular polygon cross sections may be possible. The distance, with respect to the transverse direction T, from the axis of the tool holder 400 to one of the vertices 428 may be less than the smallest radius of the frustoconical portion 410 with respect to the transverse direction T. In certain aspects, the distance, with respect to the transverse direction T, from the axis of the tool holder 400 to one of the vertices 428 may be greater than a radius of the tail portion 418.

The tool holder 400 contemplates the frustoconical portion 410 located such that a distance from the frustoconical portion to the flange 408 is less than a distance from the polygonal portion 424 to the flange 408, both distances with respect to the axial direction A. However, a configuration of the tool holder 400 where the frustoconical portion 410 located such that a distance from the frustoconical portion to the flange 408 is greater than a distance from the polygonal portion 424 to the flange 408, both distances with respect to the axial direction A, may be possible.

The tool holder 400 may have a necked down portion 432 abutting the flange 408 at the second end 406. The necked down portion 432 may have a diameter, as measured in the transverse direction T that is smaller than the diameter of the cylindrical body 402 at an opposing side of the flange 408, as measured in the transverse direction T. The necked down portion 432 may serve to create a failure point for shear loads on the tool holder 400 so that the tool holder 400 breaks at the necked down portion 432 rather than inside the mounting bore 114 (FIG. 1) where it can be difficult and time consuming to remove.

Figure 11:
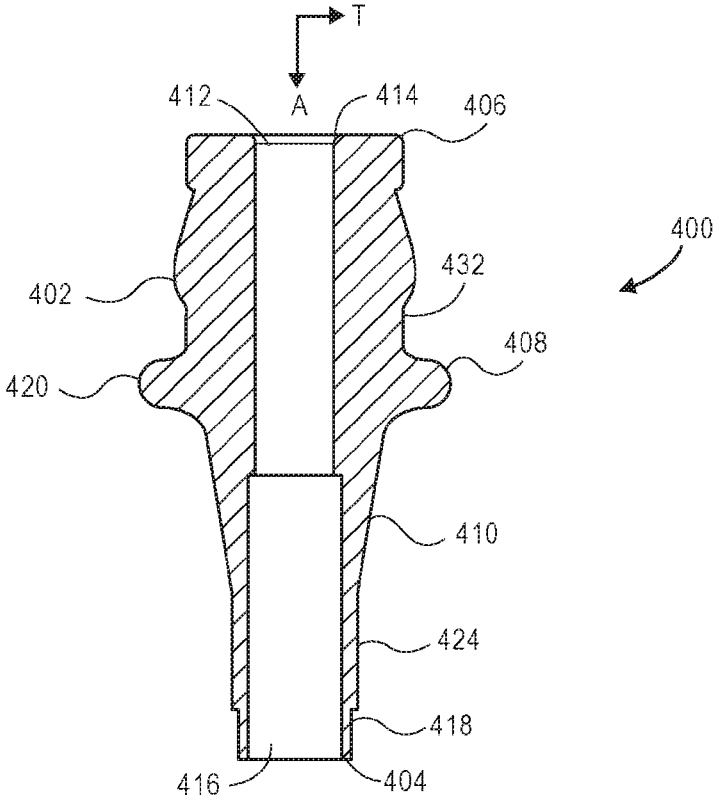
FIG. 11 is a sectional view of the tool holder of FIG. 7.

As seen in FIG. 11, the diameter of the first bore 412 may be greater than the diameter of the second bore 416 as measured in the transverse direction T. In another aspect, the first bore 412 may have a smaller diameter than the second bore 416 as measured in the transverse direction T. In yet another aspect the first bore 412 may have an equal diameter to the second bore 416 as measured in the transverse direction T.

Figure 12:
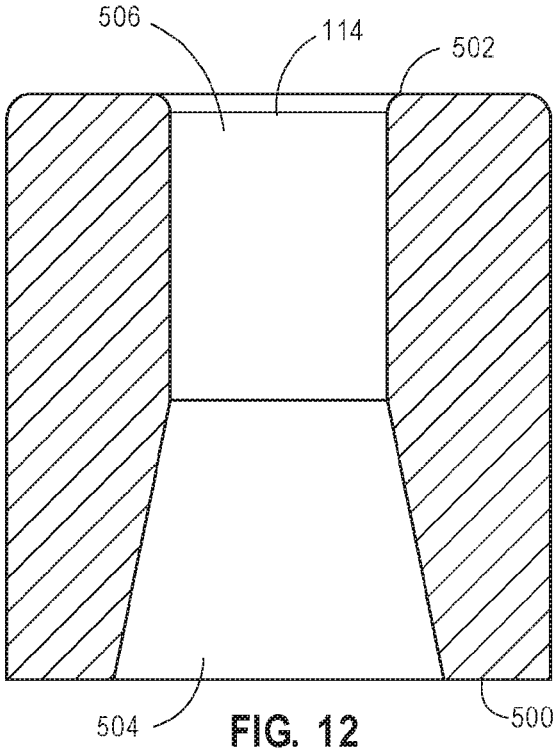
FIG. 12 is a sectional view of the mounting portion of the exemplary tool mounting block of FIG. 1.

Referring to FIG. 12, a sectional view of an exemplary aspect of the mounting bore 114 of the tool mounting block 108 (FIG. 1) is shown. The aspect shown in FIG. 12 is contemplated to be configured to receive the tool holder 110, but other configurations are contemplated to allow the tool holders 200, 300, 400 to be installed in the mounting bore 114. The mounting bore 114 may have a proximal opening 500 and a distal opening 502. The mounting bore 114 may further have a taper fit mating bore 504 and a press fit mating bore 506. The taper fit mating bore 504 may be located abutting the proximal opening 500; however, in other aspects the taper fit mating bore 504 may be located abutting the distal opening 502. The taper fit mating bore 504 may be configured with a length and taper so that when a tool holder is installed in the tool mounting block 108, the taper fit mating bore 504 may be in contact with the frustoconical portions 210, 310, 410 (FIGS. 2-7) and a taper fit may be formed. The taper fit is contemplated as a self-holding taper, but other taper fits may be possible.

The press fit mating bore 506 may be located abutting the distal opening 502, however, in other aspects the press fit mating bore 506 may be located abutting the proximal opening 500. The press fit mating bore 506 may be configured with a length and diameter so that when a tool holder is installed in the tool mounting block 108 the press fit mating bore 506 may be in contact with the cylindrical portion 212 (FIGS. 2-4), the elliptical portion 320 (FIG. 5), or the polygonal portion 424 (FIGS. 7-11) and a press fit may be formed. A press fit being a type of interference fit created by using force to press the interfering parts together is contemplated, but other types of interference fits may be possible.

In the aspects of this disclosure the tool holders 200, 300, 400 and the cutting bit 112 are contemplated as two separate components that are assembled together. However, also contemplated is a single bit that may have the same features as the tool holder aspects 200, 300 and 400 except that the second end 206, 306, or 406 is configured with an integral cutting bit rather than configured to accept the removable cutting bit 112.

INDUSTRIAL APPLICABILITY

The disclosed tool holder and milling drum may be used within any cold planer for the fragmenting and removal of roadway surface material. The disclosed tool holders and milling drum may improve longevity of machine components and milling performance while also decreasing servicing difficulty, time, and expense.

Component longevity and milling performance may be increased through the unique design of the disclosed tool holders that functions to increase the retention of the tool holder within the tool mounting block. This unique design may include, among other things, the combination of taper-fits and press fits through the combination of a frustoconical portion with one of a cylindrical, polygonal, or elliptical portion. This unique design may also include particular dimensions of these portions to achieve improved axial and transverse load resistance.

The combination of taper fit and press fit provides the tool holder with a more robust connection to the tool mounting block 108 A taper fit with a small angle resists axial loads well, but can become lodged when exposed to high axial forces. A large taper angle is less susceptible to lodging the tool holder in the mounting bore 114, but is less able to handle transverse loads without causing the tool holder 110 to dislodge from the mounting bore 114. The press fit allows the use of a larger taper angle (to prevent lodging under heavy axial load) while providing retention for the tool holder 110 when subject to significant transverse loads during operation.

By increasing the retention within the tool holder fewer tool holders and cutting bits will be lost during operation of the milling drum, maintaining the as designed performance of the milling drum. In addition, tool holders and bits that separate from the milling drum during use are often lost or damage, thus improving retention allows fewer replacements. At the same time improving retention without using fasteners such as clips or pins allows the tool holders to be quickly removed and replacements quickly installed when needed, reducing service time and expense.

To install a tool holder 110 a hammer or press (not shown) may be used to insert the tool holder 110 into the mounting bore 114 of the tool mounting block 108. A hammer or pry bar may be used to remove the tool holder 110 when replacement or service is needed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A milling drum comprising:
- a head having a cylindrical outer surface;
- a plurality of tool mounting blocks arranged into spiraling rows on the cylindrical outer surface of the head;
- a plurality of tool holders, each of the plurality of tool holders including:
  - a cylindrical body defining a first end received within a mounting block bore of one of the plurality of tool mounting blocks, and the cylindrical body defining, a second end, the second end configured to receive a cutting bit;
  - a flange located between the first end and the second end with respect to an axial direction;
  - a first bore with a first opening defined by the second end, the first bore extending along the axial direction towards the first end;
  - a frustoconical portion located between the flange and the first end with respect to the axial direction; and
  - a polygonal portion with a cross section that is a finitely-sided polygon located between the flange and the first end with respect to the axial direction;
- wherein the frustoconical portion is configured to form a taper fit with the mounting block bore of the one of the plurality of mounting blocks; and
- wherein the polygonal portion is configured to form a press fit with the mounting block bore of the one of the plurality of mounting blocks.

2. The milling drum of claim 1, wherein the frustoconical portion extends from a first end adjacent to the flange to a second end adjacent to the polygonal portion, and wherein an outer surface of the frustoconical portion maintains a constant taper angle from the first end to the second end.

3. The milling drum of claim 1, wherein the taper fit between the mounting block bore and the frustoconical portion is a self-holding taper fit.

4. The milling drum of claim 1, wherein a distance from the first end to the polygonal portion with respect to an axial direction is less than a distance from the first end to the frustoconical portion with respect to the axial direction, and wherein an axial length of the frustoconical portion is greater than an axial length of the polygonal portion.

5. The milling drum of claim 1, wherein the cross-section of the polygonal portion has between three and twelve sides.

6. The milling drum of claim 1, wherein the first bore extends through an entire length of the tool holder.

7. The milling drum of claim 1, further including a second bore generally aligned with the first bore, the second bore with a first opening defined by the first end and the second bore extending along the axial direction towards the second end.

8. The milling drum of claim 1, further including a tail portion located between the polygonal portion and the first end with respect to the axial direction.

9. The milling drum of claim 8, further including a through hole passing transversely through the cylindrical body at the tail portion, the through hole configured to receive a pin therein.

10. The milling drum of claim 1, wherein the frustoconical portion has a taper angle between about 0 degrees and about 9 degrees.

11. The milling drum of claim 1, further including at least one radial opening, at least a portion of the at least one radial opening extending through a wall of the cylindrical body to intersect with and be open to the first bore.

12. The milling drum of claim 1, wherein the cross section of the polygonal portion is a regular polygon.

13. The milling drum of claim 1, wherein a plurality of vertices of the cross section of the polygonal portion are rounded with a radius of about 5 millimeters.

* * * * *